United States Patent [19]

Yablochnikov

[11] 4,129,846

[45] Dec. 12, 1978

[54] INDUCTOR FOR MAGNETIC PULSE WORKING OF TUBULAR METAL ARTICLES

[76] Inventor: Boris A. Yablochnikov, ulitsa Chaplygina 39, kv. 4, Novosibirsk, U.S.S.R.

[21] Appl. No.: 604,477

[22] Filed: Aug. 13, 1975

[51] Int. Cl.[2] ..... H01F 15/04; H01F 27/28

[52] U.S. Cl. ..... 336/84 C; 336/180; 336/192; 336/223

[58] Field of Search ..... 336/180, 183, 223, 84 C, 336/192, 232, 186; 219/9.5, 7.5, 10.79, 149, 150, 15 L, 6.5; 72/56

[56] References Cited

U.S. PATENT DOCUMENTS

| | | | |
|---|---|---|---|
| 316,354 | 4/1885 | Gauland et al. | 336/223 X |
| 2,474,395 | 6/1949 | Early et al. | 336/183 X |
| 3,099,010 | 7/1963 | Taylor | 336/180 X |
| 3,203,211 | 8/1965 | Mallinckrodt | 219/6.5 X |
| 3,312,919 | 4/1967 | Ross | 336/84 |

FOREIGN PATENT DOCUMENTS

| | | | |
|---|---|---|---|
| 1233943 | 2/1967 | Fed. Rep. of Germany | 336/180 |
| 461545 | 3/1968 | Japan | 336/223 |

OTHER PUBLICATIONS

"Engineering of High Pulsed Currents and Magnetic Fields", by P. V. Dashuk et al., published by Atomizdat, Moscow, 1970, pp. 404–409.

*Primary Examiner*—Thomas J. Kozma
*Attorney, Agent, or Firm*—Lackenbach, Lilling & Siegel

[57] ABSTRACT

Disclosure is made of an inductor for magnetic pulse working of tubular metal articles, wherein the coil is composed of flat conductors insulated from one another and manufactured in the form of at least a sector portion of an annular disc helically bent at a pitch that ensures a displacement of a conductor's ends relative to one another by the length of the coil. Said flat conductors are assembled into a multiple helix. On one side, the ends of said flat conductors are arranged in one plane normal to the coil axis and circumferentially spaced relative to one another at equal angles.

Due to the change in the inductance from a value equal to the inductance of a portion of a hollow tubular conductor to that of a single-turn inductor whose turn has geometrical dimensions equal to the dimensions of the inductor coil, the inductor of the present invention makes it possible to carry out magnetic pulse working of large-diameter metal articles.

11 Claims, 5 Drawing Figures

INDUCTOR FOR MAGNETIC PULSE WORKING OF TUBULAR METAL ARTICLES

The present invention relates to means for working of metal articles by pressure of a pulsed magnetic field and, more particularly, to inductors for magnetic pulse working of tubular metal articles by pressure of a pulsed magnetic field.

At present, magnetic pulse working of tubular metal articles involves the use of three basic types of inductors: single-layer helical inductors, single-turn inductors, and inductors comprising a multiturn winding and a magnetic flux concentrator. These types of inductors have been evolved and perfected both experimentally and in the course of actual magnetic pulse working of tubular metal articles.

The single-layer spiral inductor is the commonest type of inductor to produce pulsed magnetic fields with an intensity of more than 100 kilooersteds. Its coil is made from a solid, helically milled metal cylinder. This inductor has a relatively high mechanical strength, and its coil effectively withstands both axial and radial pressures.

The basic disadvantages of the single-layer spiral inductor are a low permissible voltage across its coil (less than 10 kV) due to the danger of an insulation breakdown between turns, and high production costs.

The single-turn inductor is extensively employed to produce powerful magnetic fields. It is advantageous in that it is simple to manufacture and has a high mechanical strength.

The major disadvantage of the single-turn inductor lies in the weakening of the magnetic field in the turn slot area, which results in a non-uniform deformation of tubular articles in the course of magnetic pulse working of such articles.

The inductor comprising a multiturn winding and a magnetic flux concentrator with a radial slot and an axial opening to receive a tubular metal article being worked has a high mechanical strength and can be readily adjusted for working articles of different gauges. The adjustment is performed by changing inserts in the concentrator.

The basid disadvantage of the latter type of inductor resides in undesirable losses of energy due to effective resistances and scattering fields produced by the multiturn winding and the magnetic flux concentrator.

The common disadvantage of the above-mentioned types of inductor lies in that it is hard to ensure a sufficiently high current frequency in the inductor in working large-diameter tubular articles. The problem will be dealt with in greater detail below.

There is further known an inductor for producing a pulsed magnetic field H. P. Furth and R. W. Waniek, Rev. Sci. Instrs. Vol. 27, No. 4, page 195 (1956), comprising a coil composed of flat conductors. Each conductor is an annular disc punched from sheet metal. In the coil, the discs are placed in series, for which purpose each disc has a sector portion displaced in the course of the punching operation relative to the rest of the disc by a value equal to the disc thickness. As the discs are assembled into a coil, they are insulated from one another by spacers having the shape of annular discs without a sector portion equal to the sector portion of the electrically conducting annular disc, displaced by the punching. This type of inductor has a high mechanical sterngth and is easy to manufacture.

It is disadvantageous, however, in that the annular discs can only be placed in series. In working large-diameter articles, this substantially raises the inductor's inductance.

Hence, in order to ensure a sufficiently high natural oscillation frequency of the discharge circuit employed in working metal articles by a pulsed magnetic field, which discharge circuit, as a rule, comprises, apart from an inductor, a switch and a capacitor bank, it is necessary to substantially reduce the capacity of said capacitor bank. This, in turn calls for the use of high-voltage capacitor banks to provide for a required store of energy. An increased working voltage of the capacitor bank, however, leads to the danger of an insulation breakdown in individual units of the device and in the inductor coil. The known inductor design makes it extremely difficult to cool the middle portion of the coil by transfer of heat to the inductor's current leads due to the heat conduction of the conductors that make up the coil. Therefore, special coil cooling means must be provided for in order to avoid overheating in the case of a high repetition frequency of current pulses. In addition, in cases of high current densities corresponding to magnetic field intensities of more than 100 kilooersteds, in the areas of contact between the annular discs there appear electric arcs which may damage the insulation and render the inductor coil inoperable.

It is an object of the present invention to eliminate the above-mentioned disadvantages of the known inductor design.

It is another object of the present invention to provide an inductor having a substantially reduced inductance, as compared to conventional inductor designs, with equal geometrical dimensions of the coils and equal thicknesses of the flat conductors and insulators that make up the coils.

The foregoing objects of the present invention are attained by providing an inductor for magnetic pulse working of tubular metal articles, whose coil is assembled from flat conductors insulated from one another, in which inductor each said conductor is made, in accordance with the invention, as at least a sector portion of an annular disc, helically bent at a pitch to ensure a displacement of conductor ends relative to one another by the length of the coil, said conductors being assembled into a multiple helix, their ends on one side being arranged in one plane normal to the coil axis and circumferentially spaced relative to one another at equal angles.

It is expedient that said flat conductors should have leads on the side of their inner or outer circumferential edges and in immediate proximity to the ends of said flat conductors, which leads should be made as a single whole with eaid flat conductors.

It is advisable that leads should be arranged in immediate proximity to the ends of said flat conductors, on the side of their inner or outer circumferential edges.

The proposed inductor reduces its inductance to a value equal to the limiting inductance of a portion of a hollow tubular conductor. The maximum inductance of the proposed inductor corresponds to that of a single-turn inductor whose turn has geometrical dimensions equal to those of the proposed inductor's coil. This is due to the fact that it is only possible to punch a flat conductor from sheet metal in the form of a single turn. Provision of inductors whose inductance can be varied within the aforesaid limits opens up new possibilities for magnetic pulse working of large-diameter articles. The use of inductors of the present invention makes it possible to maintain the required high frequency of the pulsed magnetic field in working thin-wall articles whose diameter may be practically unlimited. The working voltage of the capacitor bank is maintained at a low level (5 to 10 kV). The limiting diameter of an article being worked is determined in fact, by the size and cost of the capacitor bank.

The basic advantage of the proposed inductor resides in effective transfer of heat from the coil through the heat conducting leads. Compared to a conventional-type inductor of similar size, the heat removal from the inductor's coil, for example, the one having a coil assembled from flat conductors in the form of a complete annular disc, is $n^2$ times greater (n being the number of flat conductors which is the same for both inductors). This makes it possible to dispense in most cases with a special means for cooling the coil of the proposed inductor.

The inductor of the present invention is also advantageous in a low voltage across the insulation between the flat conductors. In producing pulsed magnetic fields of the same amplitude and pulse duration, the voltage across the insulation between the flat conductors in the case of the proposed inductor is $n^2$ times less than in the case of the conventional inductor (as in the previously discussed case, it is understood that the geometrical dimensions of the inductors' coils, and the sizes of the flat conductors and insulators are equal).

Other objects and advantages of the present invention will become more apparent from the following detailed description of preferred embodiments thereof taken in conjunction with the accompanying drawings, wherein.

Referring now to the attached drawings, the proposed inductor for magnetic pulse working of tubular articles comprises, according to the invention, a coil composed of flat conductors 1 (FIGS. 1 and 2) made from a metal, for example, copper. The flat conductor 1 is made in the form of a complete annular disc having a radial slot. At the ends of said disc, on the side of its outer circumferential edge, there are leads 2. If the inductor is intended for magnetic pulse working of tubular metal articles by radially deforming said articles in the direction from an article's axis, the inductor should be installed inside an article to be worked. In this case it is advisable that the leads 2 of the flat conductors 1 should be arranged on the side of the inner circumferential edge of the disc. It is clear that the leads 2 may be made as a single whole with the flat conductors 1 only in the case of a large-diameter inductor. In the case of a small-diameter inductor, the leads 2 may be manufactured separately and then connected to the flat conductors 1. In the course of manufacturing the inductor, the leads 2 are, as a rule, bent at the right angle to the plane of the conductor 1 to facilitate the assembly of the inductor and subsequently connect it to current leads.

Figure 3:
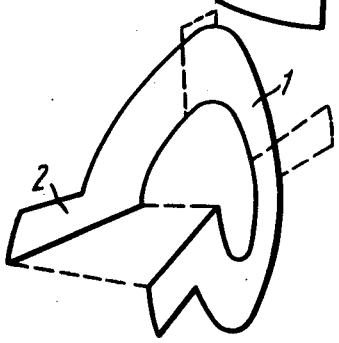
FIG. 3 is a perspective view of a flat conductor in the form of a helically bent complete annular disc provided with leads at the ends of said conductor, on its outer circumferential edge, which leads are made as a single whole with said conductor.
Figure 4:
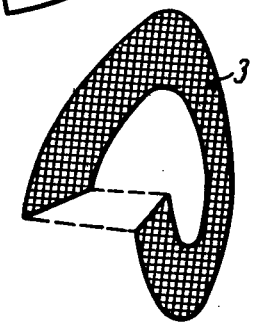
FIG. 4 is a perspective view of an insulator between conductors.

As a maximum, the flat conductors 1 may be constructed in the form of a complete annular disc. It should be noted in this connection that in principle, the flat conductors 1 in the form of a complete annual disc may be assembled into a mutliturn coil, for example, by successively welding the annular discs to one another. However, it is difficult, from the viewpoint of technological effectiveness, to manufacture an inductor coil in this manner. Moreover, such a coil proves to be of inferior quality due to a non-uniformity of the mechanical characteristics of the metal in the welding zone. It is expedient, therefore, that inductors of the proposed type should be made from only flat conductors 1 in the form of a complete annular disc or at least a sector portion of the annular disc. In the latter case, the sector portion may constitute, for example, three-quarters, a half, a quarter, etc. of the complete annular disc (possible embodiments are shown in FIG. 3 by the dotted lines). The limiting size of a sector portion of the annular disc is equal to the length of the inductor coil. The inductor coil assembled from the flat conductors 1 is equivalent to a hollow cylindrical conductor and, therefore, is of no practical value. In order to approximately assess the required minimum size of the sector portion of the annular disc, one may use the following formula:

$$\alpha R \approx 3\ 1 \qquad (1),$$

where $\alpha$ is the angle that limits the sector portion of the annular disc, in radians;

R is the radius of the circumference that limits the sector portion of the annular disc and is free from leads (the circumference that defines the working surface of the inductor coil); and 1 is the length of the inductor coil.

The size of the flat conductors 1 made in the form of a sector portion of an annular disc, evaluated with the aid of the equation (1), ensures a pressure of the pulsed magnetic field produced by the coil of the inductor assembled from such inductors 1, which is approximately 10 times as high as the pressure of the pulsed magnetic field produced by the current leads connected to the inductor. It is assumed that the current leads are constructed as cylindrical tuves, the inner and outer diameters of the tubes being equal to the respective diameters of the inductor coil.

In order to assemble a coil, the flat conductors 1 are helically bent at a pitch which ensures a displacement of the ends of the conductor relative to each other by the length of the coil (FIG. 3).

Arranged between the flat conductors 1 are insulators 3 (FIGS. 1, 2, 4, and 5) which are shaped as the flat conductors 1, with the exception of the portions of the respective leads 2 that are absent in the insulators 3 in every case. The insulators 3 are punched from flat sheet material, for example, fiber-glass laminate.

Figure 1:
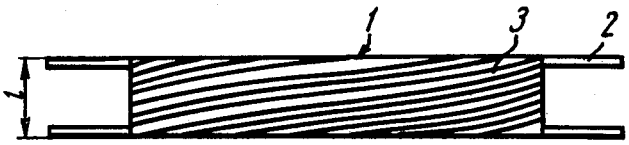
FIG. 1 is a side elevational view of a coil of a six-thread inductor.
Figure 2:
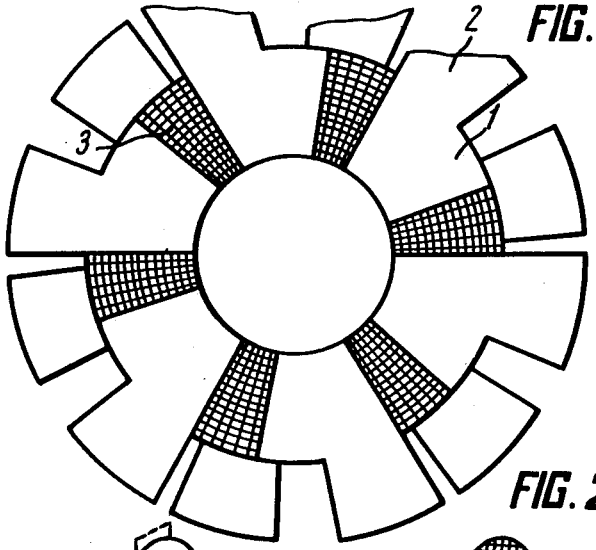
FIG. 2 is a front plan view of the coil of the six-thread inductor.

The flat conductors 1 with or without the leads 2, and the insulators 3 are assembled into a multiple helix (FIGS. 1 and 2). On one side, the ends of the flat conductors 1 and the insulators 3 are circumferentially spaced relative to one another at equal angles. In order to assemble the inductor, the leads 2 are bent at the right angle to the plane of the sector portion of the annular disc (FIG. 5).

Figure 5:
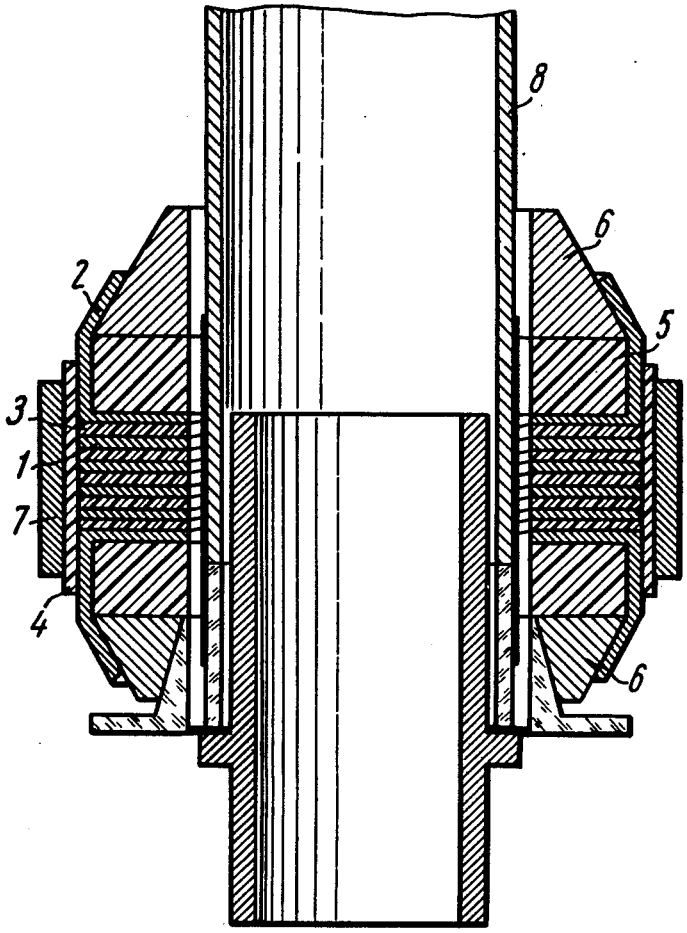
FIG. 5 is an axial cross sectional view of an assembled inductor.

The assembled inductor is shown in FIG. 5. The flat conductors 1 with the leads 2 and the insulators 3 are enveloped by an outer insulator 4. On the sides, they are protected by insulating washers 5. Adjoining the end-face washers 5 are taper metal washers 6. Arranged on the outside of the outer insulator 4 is an electrodynamic unloading screen 7. A tubular metal article 8 is placed inside the inductor. The leads 2 are bent over the taper washers 6, whereto said leads 2 may be connected.

In the inductor design under review, current leads (not shown) for connection to a pulsating current generator (not shown) may be constructed as tubes or flat buses having tapered openings for contact with the leads 2 of the inductor.

Prior to operation, the inductor is connected to the current leads. Said current leads are used for preliminary axial compression of the inductor (for example, with the aid of coupling bolts). The axial compression ensures good contact between the leads 2 and the current leads of the pulsating current generator, which improves the coil's operation.

The proposed inductor operates as follows. From the pulsating current generator, pulsating current is applied to the leads 2. While flowing through the flat conductors 1, said current produces a pulsed magnetic field around said conductors 1, which field induces reverse currents in the tubular article 8 being worked and the electrodynamic unloading screen 7. The pressure of the pulsed magnetic field thus produced is concentrated between the flat conductors 1 and the article 8 and deforms the latter along the radii to the axis of said article 8. The pressure of the pulsed magnetic field, concentrated between the flat conductors 1 and the electrodynamic unloading screen 7 partially reduces the reaction of said conductors 1 to loads produced in the course of deformation of the article 8. This reduces the mechanical load on the insulator 4.

The heat released in the flat conductors 1 is transferred therefrom through the leads 2 to the current leads which can be easily cooled, for example, by water. The rate of heat transfer through a heat conductor is known to be proportional to the sectional area of the conductor (in the present case, the conductor 1), and inversely proportional to its length. Hence, the heat transfer through a short conductor with a large cross-sectional area is more intensive than through a long conductor with a small cross-sectional area. Compare, for example, the resistance to the heat flux of the coil composed of the flat conductors 1 of the above-mentioned six-thread single-turn inductor (i.e. the inductor whose flat conductor 1 is made as a complete annular disc) with the resistance of a single-thread six-turn inductor. As elsewhere in the text of the disclosure, it is assumed that the geometrical dimensions of the inductor coils, and the thicknesses of the annular dics and insulators that make up the coils are all equal. It is clear to see that in the known inductor the heat flux passes successively through all the flat conductors 1, which means that the total length of the equivalent conductor amounts to 6*b*, where b is the mean length of one flat conductor.

The section of the equivalent conductor is equal to that of the actual flat conductor designated S. The known inductor can only be cooled via a pair of the leads 2.

In the proposed inductor, the flat conductors 1 are interconnected in parallel for the passage of the heat flux. This means that the total length of the equivalent conductor remains equal to b, whereas its sectional area is equal to 6S. The proposed inductor is cooled via twelve leads 2. As a result, the resistance to the heat flux from the coil in the proposed inductor design is 36 times less than in the known inductor. Thus, the inductor of the present invention is effectively cooled by removing heat via the flat conductors 1. Simple calculation shows that the voltage across the insulation between the flat conductors 1 of the proposed inductor is much smaller than in the case of the conventional inductor. Suppose we have to produce pulsed magnetic fields of an equal amplitude H and a frequency ($\omega$) with the aid of an oscillating circuit LC. In this case $$H \sim I = \frac{U_1}{\omega L_1} = \frac{U_2}{\omega L_2} \quad \text{(2), where}$$

$U_1$ and $L_1$ are the required voltage across the proposed single-turn six-thread inductor, and its inductance, respectively; $U_2$ and $L_2$ are the required voltage across the conventional six-turn single-thread inductor, and its inductance, respectively.

We know that $$L_2 = n^2 . L_1 \quad (3),$$

where n is the number of the flat conductors (in the present case n = 6).

Substitute now equation (3) into equation (2). After the transformation the result will be:

$$U_1 = \frac{U_2}{n_2} \quad (4).$$

It should be borne in mind that the number of the insulators 3 in relation to the coil length is equal in both cases. Hence, the voltage across one insulator 3 in the coil of the proposed inductor is $n^2$times less than in the case of the conventional inductor. This is extremely important as regards the service life of the inductor.

The inductor of the present invention was tested for three years, during which period it was used for magnetic pulse welding of heavy-metal tubular articles. Articles to undergo deformation were copper and steel pipes with a wall thickness of 1 to 2.5 mm and a diameter of 30 to 130 mm. The inductor coil was made of copper. For working articles with a diameter of up to 50 mm, use was made of inductors with flat conductors made in the form of a complete annular disc, and inductors where the flat conductors constituted 0.6, 0.75, and 0.5 of sector portions of the annular disc. The number of the conductors varied between 6 and 12. The inductor for working articles having a diameter of 130 mm was wholly made up of conductors constituting 0.33 of the sector portion of the annular disc; the number of the flat conductors in this case was 18. The voltage across the capacitor banks was never in excess of 5 kV.

The performance of the inductors was excellent. They withstood, without any negative effects, currents of up to $3.10^6$ a. It should be pointed out that there was never a case of an insulation breakdown between the flat conductors even in the presence of very powerful magnetic fields that cause yielding of copper and deformation of flat conductors. This is largely accounted for by the absence of any contacts between the flat conductors 1 in the coil's working zone. The parallel connection of said conductors is effected at the place of their contact with the external current leads. As a result, even arc discharges, which may be caused between the leads 2 and the current leads due to poor contact there-between, cannot lead to a breakdown of the insulator 3 between the flat conductors 1 and thus put the inductor out of operation. Besides, the proposed inductor is cheap and easy to manufacture, so it is economically practicale to employ it for producing super-powerful magnetic fields, i.e. in situations when the service life of the inductor is no more than about 1,000 working cycles.

What is claimed is:

1. An inductor for magnetic pulse working of tubular articles, comprising: a coil composed of flat conductors insulated from one another, said conductors each being made as a sector portion of an annular disc of less than one full turn, which sector portions are helically bent along the axis of said coil at a pitch that ensures a displacement of the ends of each conductor relative to each other by the axial length of said coil, said conductors being assembled into a multiple helix, and the ends of said conductors on at least one axial end of said coil being arranged in one plane substantially normal to the coil axis and circumferentially spaced relative to one another at substantially equal angular spaces or increments.

2. An inductor as defined in claim 1, wherein said conductor opposite ends are arranged in respective spaced parallel planes substantially normal to the coil axis.

3. An inductor as defined in claim 1, wherein said plane is normal to the coil axis.

4. An inductor as defined in claim 1, wherein said ends are equally spaced relative to one another.

5. An inductor as defined in claim 1, wherein said conductors have inner and outer circumferential edges, and further comprising at least one lead connected to said conductors at at lest one of said edges.

6. An inductor as defined in claim 1, wherein said conductors have inner and outer circumferential edges, and further comprising at least one lead forming part of or integrally formed with said conductors at at least one of said edges.

7. An inductor as defined in claim 1, wherein said conductor ends are provided with radially projecting lends bent at a right angle to the planes of said flat conductors.

8. An inductor as defined in claim 1, wherein said conductors are enveloped by an outer insulator.

9. An inductor as defined in claim 8, further comprising an electrodynamic unloading screen arranged outside of said outer insulator.

10. An inductor as defined in claim 1, wherein the axial ends of the inductor or coil are bounded by taper metal washers; and insulating washers between said flat conductors and said taper metal washers, said conductor ends being provided with radially outwardly projecting leads bent at a right angle to the planes of said flat conductors and having at least portions thereof bridging said insulating washers and connected to said taper metal washers.

11. An inductor as defined in claim 1, further comprising insulators disposed between said conductors, said insulators being made of dielectric plates in the general form of said sector portions of said flat conductors, each of said dielectric plates being placed between an adjacent pair of conductors and being circumferentially spaced relative to each other to provide a displacement of its ends by substantially the same angular spaces or increments as the corresponding ends of said conductors.

* * * * *